United States Patent [19]

Turner

[11] 3,968,671

[45] July 13, 1976

[54] COOLING BED METHOD

[75] Inventor: John F. Turner, West Lawn, Pa.

[73] Assignee: Birdsboro Corporation, Birdsboro, Pa.

[22] Filed: Aug. 27, 1975

[21] Appl. No.: 608,038

Related U.S. Application Data

[62] Division of Ser. No. 468,373, May 9, 1974, Pat. No. 3,916,660.

[52] U.S. Cl. ..... 72/14; 72/201

[51] Int. Cl.[2] ..... B21B 37/00; B21B 43/00; B21B 45/02

[58] Field of Search ..... 72/10, 12, 14, 31, 200–202, 72/342, 364; 198/27, 33; 266/2 R

[56] References Cited

UNITED STATES PATENTS

| | | | |
|---|---|---|---|
| 744,874 | 11/1903 | Neeland | 266/2 R |
| 1,992,361 | 2/1935 | Diescher | 266/2 R |
| 2,102,792 | 12/1937 | George | 72/252 |
| 2,327,734 | 8/1943 | Morgan | 266/2 R |
| 2,364,386 | 12/1944 | Peterson | 72/252 |
| 3,602,028 | 8/1971 | Klusmier et al. | 72/201 |
| 3,693,954 | 9/1972 | Toperzer et al. | 266/2 R |
| 3,852,989 | 12/1974 | Harada et al. | 72/201 |

FOREIGN PATENTS OR APPLICATIONS

| | | | |
|---|---|---|---|
| 1,311,634 | 1/1962 | France | 72/252 |
| 1,950,243 | 4/1971 | Germany | 72/252 |
| 893,526 | 4/1962 | United Kingdom | 72/252 |
| 1,074,342 | 7/1967 | United Kingdom | 72/201 |
| 201,298 | 11/1967 | U.S.S.R. | 72/201 |

*Primary Examiner*—C. W. Lanham
*Assistant Examiner*—E. M. Combs
*Attorney, Agent, or Firm*—Fred Wiviott

[57] ABSTRACT

A movable rack cooling bed for receiving hot metal strands from a rolling mill and having a dual strand run-in table and means for selectively transferring a strand from either portion of the run-in table to cooling bed holding notches for single or two-step transfer by the cooling bed carry-over mechanism. A packing mechanism is provided for forming packs of flat metal strands in one of the holding pockets of the cooling bed after which the pack may be transferred across the cooling bed where an unpacking mechanism is provided for automatically unscrambling the strand pack and for transferring individual strands to shuffle bars for removal. When strands are received by both run-in table positions, means are provided for sensing the position of successive strands and for removing strands individually from each run-in position if the time lapse between strands at each position is too great to permit both strands to be removed together without interference with succeeding strands at either position.

6 Claims, 23 Drawing Figures

FIG. 2
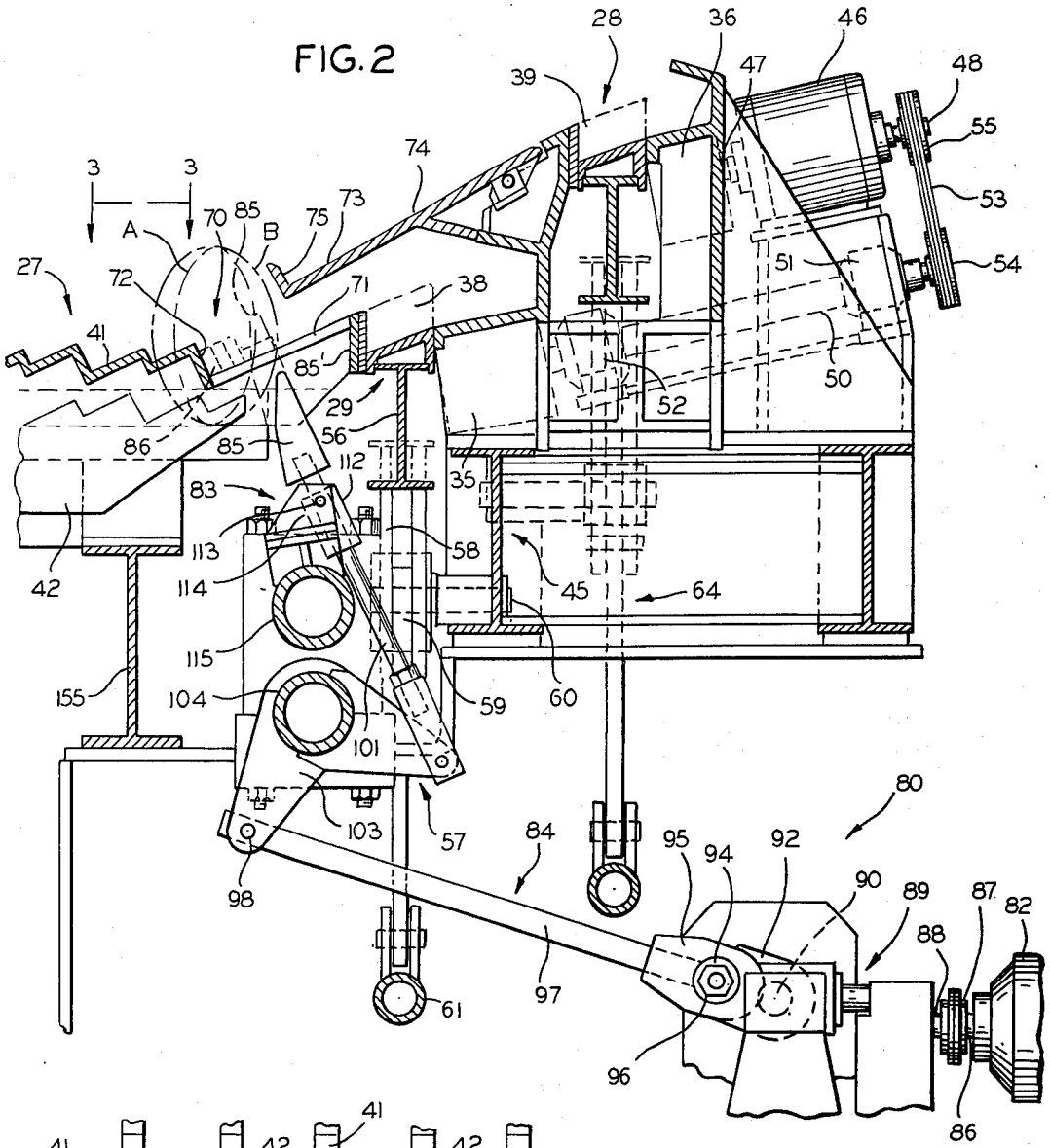
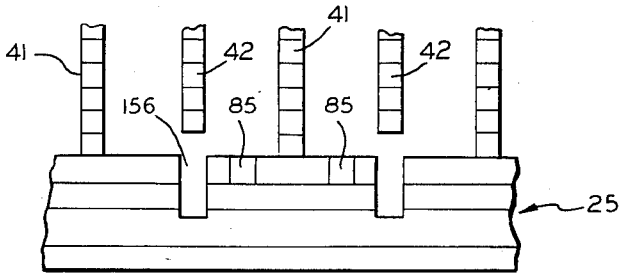
FIG. 3 time to FIG.9a time to + 1.935 FIG.9b to to + 1.935 to + 6085 FIG.9 d to + 6.085 FIG.9ℓ to + 7.5 FIG.9e to + 7.5 to + 10.365 FIG.9f to + 9.305 FIG.9n to + 10.915 FIG.9g to + 10.915

COOLING BED METHOD

This is a division of application Ser. No. 468,373, filed May 9, 1974, now U.S. Pat. No. 3,916,660.

BACKGROUND OF THE INVENTION

In conventional steel mills, steel is generally rolled into long strands having a particular cross-section obtained by selecting a particular form of roll used to shape the metal. The strands of metal, which may be in excess of 300 feet in length, usually exit the final roll at an elevated temperature. Equipment may be provided for transporting the metal strands within the mill for further processing. Cooling beds are commonly used to transport metal strands laterally of the direction of strand travel from the rolls and also provide for air cooling of the strands as they are transported across the cooling bed. Conventionally, a run-in table is provided for receiving the metal strands from the rolling mill. A kick-off mechanism may be provided at the run-in table to transfer the strands onto the cooling bed. After the strands are traversed across the cooling bed, they may be transferred by shuffle bars to a run-out table for further processing.

SUMMARY OF THE INVENTION

It is an object of the invention to provide an apparatus for cooling hot metal strands in steel mills.

It is a further object of the invention to provide a cooling bed apparatus which is operable to receive and transfer a single strand or two strands simultaneously.

A further object of the invention is to provide a cooling bed which can receive and transfer two strands simultaneously without interference with trailing strands.

A further object of the invention is to provide a new and improved apparatus for delivering elongate metallic strands to a single-sided cooling bed from a pair of inlet positions.

Yet another object of the invention is to provide means for simultaneously transferring a pair of metallic strands to a single-sided cooling bed wherein there is no interference with succeeding strands.

A still further object of the invention is to provide a cooling bed assembly with means for stacking a plurality of elongated metallic strands for simultaneous transport across the bed and for unstacking the strands at the discharge end of the bed.

Another object of the invention is to provide a cooling bed assembly for cooling and the lateral displacement of elongate metallic strands which is capable of laterally displacing a single or a pair of strands in separate pockets of the cooling bed.

It is a further object of the invention to provide a cooling bed in which strand travel is across single or alternate cooling bed pockets.

Another object of the invention is to provide a new and improved mechanism for unscrambling a pack of strands at the discharge end of a cooling bed assembly.

These and other objects and advantages of the present invention will become more apparent from the detailed description taken with the accompanying drawings.

In general, the invention comprises an upper and lower strand run-in table and a kick-off mechanism at each level for transferring metal strands to upper and lower holding pockets respectively. A sawtooth-type cooling bed is provided which may be selectively operated in a single stroke mode for handling single strands from the lower holding pocket or in a dual stroke mode for transferring metal strands from the upper and lower holding pockets simultaneously. Means are provided for sequencing the cooling bed movable carry-over rack so that the strands may be removed without interference from succeeding strands. A packing mechanism is also provided for automatically stacking flat steel strands in the lower holding pocket before transfer to the cooling bed and an automatic unpacking mechanism is provided at the end of the cooling bed for unpacking the stacked strands and transferring them to shuffle bars for removal to a run-out table.

DESCRIPTION OF THE DRAWINGS

FIG. 2 is a side elevational view with parts broken away of the kick-off assembly shown in FIG. 1;

FIG. 3 is a top plan view of the portion of the apparatus illustrated in FIG. 2;

DESCRIPTION OF THE PREFERRED EMBODIMENT

Figure 1:
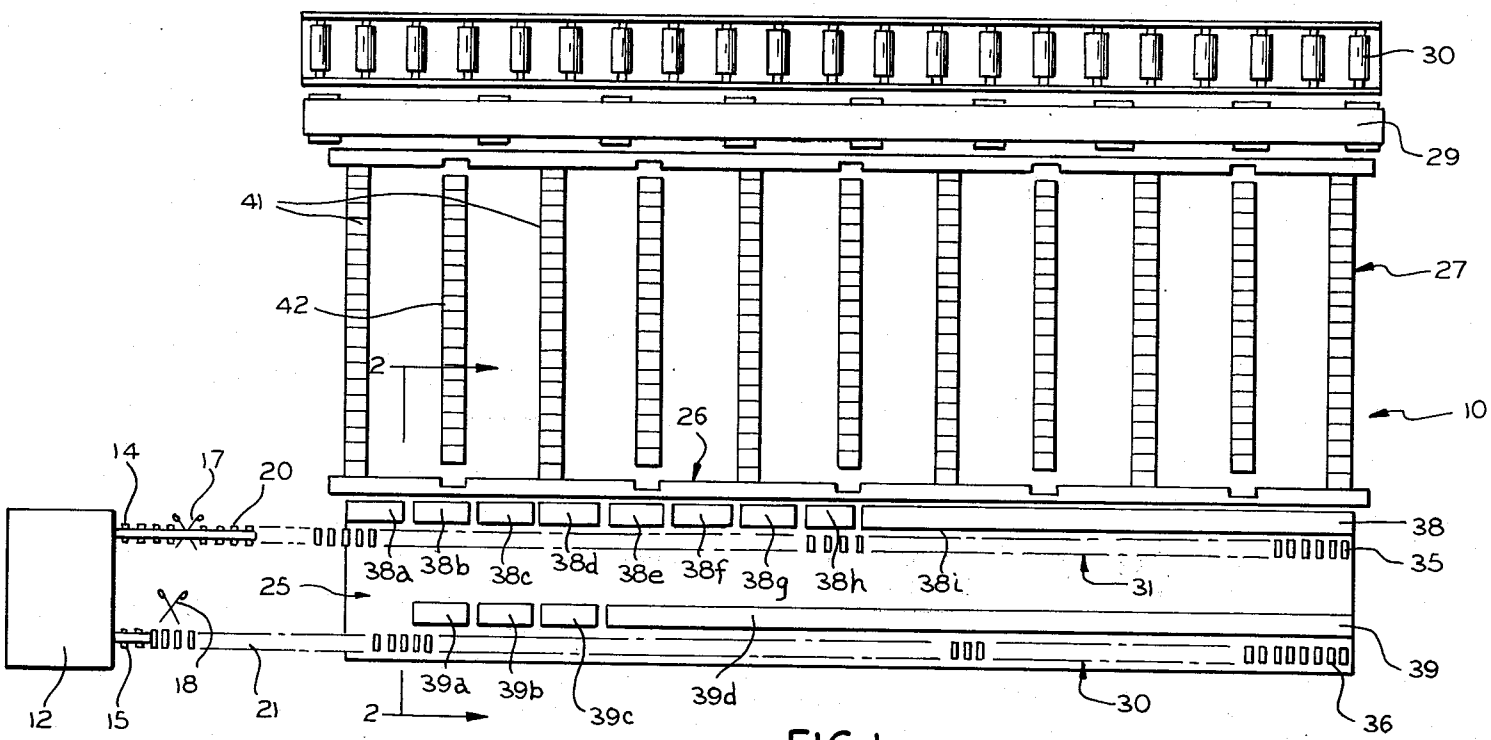
FIG. 1 is a schematic plan view of a cooling bed apparatus according to the invention.

FIG. 1 schematically illustrates a cooling apparatus 10 which may be associated with a steel rolling mill 12. The mill 12 may be adapted to discharge a first continuous strand of metal 14 and a second continuous strand of metal 15, both of which are shaped into a desired cross-sectional configuration by the rolling mill 12. The strands 14 and 15 may pass through flying shears 17 and 18, respectively, where they are cut into desired lengths. As those skilled in the art will appreciate, flying shears are well known devices adapted to cut strands while they are moving. Strands 14 and 15 may be directed from the rolling mill 12 along a lower set of run-out rolls 20 and an upper set of run-out rolls 21, respectively, which direct strands 14 and 15 to the cooling apparatus 10. Rolling mill 12, shears 17 and 18 and run-out rolls 20 and 21 are well known in the art and accordingly, need not be illustrated or described in further detail.

The cooling bed apparatus 10 generally comprises a run-in assembly 25, a kick-off assembly 26, a cooling bed 27, a shuffle bar assembly 29 and a run-out table 30. Kick-off assembly 26 receives the strands 14 and 15 and transfers them to the cooling bed 27. The kick-off assembly 26 generally includes upper and lower portions 28 and 29 each having sets of run-in rolls 35 and 36, respectively, which are in general alignment with run-out rolls 20 and 21, respectively, for receiving strands 14 and 15. The upper and lower portions, respectively, include kick-off apron 38 and 39 which are also disposed adjacent their associated run-in rolls 35 or 36, and each kick-off apron is operable to transfer strands to the cooling bed transfer assembly 27 in a manner to be described hereinafter. The lower kick-off apron 38 may be divided into a plurality of sections 38*a*

– 38*h* and an extended section 38*i*, the purpose of which will be described hereinafter. Similarly, the upper kick-off apron 39 will be divided into sections 39*a* – 39*c* and an extended section 39*d*. The kick-off aprons 38 and 39 are operative for transferring the strands 14 and 15 from the rolls 35 or 36 to cooling bed 27.

Cooling bed 27 includes a plurality of alternate stationary and movable notched transfer bars 41 and 42 which extend generally perpendicularly to the direction of strand motion along the run-in assembly 25. The movable bars 42 serve to transport strands from the run-in assembly 25 in a stepwise fashion between stationary bars 42 and across the cooling bed assembly 27 to a conventional shuffle bar assembly 29 for removal to a conventional run-out table 30 which transports strands for further processing.

As will be described more fully below, a packing mechanism 80 (FIG. 4) is disposed below the kick-off apron 38 for stacking a preselected number of flats before the latter are displaced across the cooling bed 27. Also, a pack unscrambler 251 (FIG. 10) is disposed between the discharge end of the cooling bed 27 and the shuffle bar assembly 29 for individually removing the flats in a pack on bed 27 and for delivering the same to the shuffle bar assembly.

The specific details of the kick-off assembly 26, the cooling bed transfer assembly 27 and their associated components will now be described in detail with further reference to the drawings. The run-in assembly 25, shuffle bar assembly 29 and run-out table 30 may be of any well known design and need not be described in detail.

Referring now to FIGS. 2 and 3, the run-in assembly 25 is seen to include a frame 45 which supports a plurality of prime movers 46 for driving rolls 35 and 36. Each prime mover 46 may have a first drive shaft 47 to which one of the upper run-in rolls 36 may be attached and a second drive shaft 48 extending from its opposite end for driving one of the lower run-in rolls 35. More specifically, each run-in roll 35 is affixed to one end of a shaft 50 which is rotatably mounted on framework 45 by suitable bearings 51 and 52. The opposite end of each shaft 50 may be suitably coupled to its associated drive shaft 46 such as by a belt 53 which extends around a first pulley 54 affixed to shaft 50 and a second pulley 55 affixed to prime mover output shaft 48. As seen in FIG. 2 the axes of rotation of rolls 35 and 36 are inclined downwardly toward the cooling bed 27 so that metal strands passing along the upper or lower rolls 35 or 36 will tend to move laterally toward the cooling bed 27 under the influence of gravity. The lower and upper kick-off aprons 38 and 39 are positioned respectively adjacent the depressed ends of rollers 35 and 36 and each extends longitudinally in a direction generally parallel to the direction of strand motion along rolls 35 and 36. It will be understood that while reference is made to aprons 38 and 39, the following description of the aprons and their respective lifting assemblies will be applicable to each of the sections 38*a* – 38*i* and 39*a* – 39*d*. The upper surface of the kick-off aprons 38 and 39 are also inclined downwardly toward cooling bed 27 at an angle of inclination substantially the same as the angle at which rolls 35 and 36 are inclined. The lower kick-off apron is shown in FIG. 2 to have a transverse cross-section which is generally U-shaped and inverted. The open bottom of apron 38 may be supported by means of an I-beam 56 or other similar supporting member. The apron 38 and I-beam 56 are coupled for vertical reciprocating motion by a lift assembly 57 which may include vertical links 58 which are pivotally connected to one arm of a crank 59 which is pivotally mounted intermediate its ends by a pin 60 and whose other end is pivotally connected to a longitudinally movable rod 61. It will be appreciated that movement of rod 61 in a first direction perpendicular to the plane of FIG. 2 will rock crank 59 in a first direction to elevate apron 38 from its position shown by full lines to its position shown by broken lines while return movement of rod 60 will return apron 38 to its original position. Lift apron 39 is similarly supported for reciprocation by a lifting assembly 64 which is similar to that discussed with respect to apron 38. It will be appreciated that each of the apron sections 38*a* – 38*i* and 39*a* – 39*d* will be provided with an individually operable lift assembly 57 or 64 so that said aprons may be reciprocated in groups while others are held stationary as will be discussed below.

Aprons 38 and 39 are shown in FIG. 2 in their lowermost positions at which point their inclined upper surfaces are in general alignment with the inclined uppermost portions of the peripheries of rolls 35 and 36. The aprons 38 and 39 are movable by lift assemblies 57 and 64 to an extreme upper limit of travel as indicated by broken lines or to an intermediate position.

As is also seen in FIG. 2, the lower kick-off assembly portion 29 includes a holding notch 70 comprising a section which is generally L-shaped in vertical cross-section with a long leg 71 inclined generally downwardly toward the cooling bed 27 and having a short leg 72 extending generally upwardly. The holding notch 70 is positioned so that its inclined leg 71 is in general alignment with the top surface of kick-off apron 38 when the latter is in its uppermost position 67. Accordingly, when kick-off apron 38 is in its lowermost position and a strand is deposited on the run-in table along lower rolls 35, the strand will move laterally from roll 35 to the upper surface of apron 38 due to the inclination of these members. This will also commence the skidding action which begins to slow the strand from its maximum speed attained on the rolls 35. The strand may then be transferred to the holding notch 70 by actuating the lifting mechanism 57 to elevate apron 38 to its position shown by full lines in FIG. 2 whereupon the strand is free to move onto surface 71 of pocket 70 where it will skid to a stop. Transfer of the strand to the cooling bed 27 may then be effected in a manner to be described hereinafter. The short leg 72 of holding notch 70 is integral with the stationary carry-over bars 41. The upper kick-off assembly portion 28 has a similarly constructed holding notch 73 having a downwardly inclined long leg 74 terminating in a generally upwardly extending short leg 75 and positioned so that the inclined leg 74 is in general alignment with the top surface of upper apron 39 when the latter is in its uppermost position shown by broken lines. Thus, a strand disposed on the upper run-in rolls 36 may be transferred to the upper holding notch 73 in a manner similar to that described for the lower holding notch 70.

FIGS. 2 and 4, 4*a* and 4*b* show the kick-off assembly 26 to include a packing mechanism 80 for stacking flat strands in the lower holding pocket 70. While one such packing mechanism 80 is shown, it will be understood that a plurality of such assemblies may be spaced along the length of kick-off assembly 26 for concurrent operation. As seen in FIG. 2, the packing mechanism 80 generally comprises a prime mover 82 which drives a packing plunger assembly 83 through a drive linkage 84. The plunger assembly 83 is reciprocated vertically through openings 85' formed in the lower holding pocket 70 for moving a plunger head 85 into engagement with successive flats 86 which are successively disposed in the holding pocket 73 in a manner previously discussed. When a flat 86 is received in pocket 73, it is oriented generally with its longer cross sectional side in engagement with surface 74 as shown by broken lines in FIG. 2. As the plunger assembly 83 reciprocates, the head 85 engages the flat 86 in an off-center location for tilting the latter to its edgewise position shown by full lines in FIG. 2. As will be discussed more fully below, the plunger assembly is pivotal clockwise as viewed in FIG. 2 so that as each successive flat 86 is disposed in pocket 70, the plunger head will be in position to engage a corresponding portion of each to tilt the same into a stack with all flats oriented in the manner of the initial flat 86.

In the preferred embodiment, each packing assembly includes a pair of plunger assemblies 83 each coupled to motor 82, only one of which is shown in FIG. 2. Toward this end, motor 82 has an output shaft 86 connected by coupling 87 to the input shaft 88 of a gear reducer assembly which in turn has a pair of output shafts 90 (only one is seen in FIG. 2) which extend in axial alignment from its opposite sides and generally perpendicularly relative to the axis of input shaft 88. Each output shaft 90 and 91 drives one of the plunger assemblies through one of a pair of identical linkage assemblies 84. Since the linkages 84 and packing plunger assemblies 83 are identical for each half of the pair, only the linkage 84 and plunger assembly 83 driven by output shaft 90 are shown and described. Linkage assembly 83 includes a radially extending crank member 92 which is suitably coupled for rotation with shaft 90. A pin 94 extends from a suitable opening in crank 92 with the pin axis generally parallel to and displaced from the axis of shaft 90. The pin 93 extends through a rod connection 95 which may be suitably journaled for rotation on pin 93 by means such as bearings 96. A connecting rod 97 may be affixed at one end of the connection 95 and extends radially from pin 94 and toward the packing plunger assembly 83 and has a clevis 98 connected to its other end. It will thus be appreciated that as shaft 90 and crank 92 rotate, the connection 94 journaled on pin 93 and rod 97 will reciprocate to drive the packing plunger assembly 83 in a manner which will be described hereinafter.

With further reference to FIG. 2, the packing plunger assembly 83 includes a generally vertically extending packing rod 101 having the plunger head 85 affixed to its upper end is pivotally connected at its opposite end to one arm of a generally L-shaped crank 103 is secured to a generally horizontally extending packing shaft 104 which may by pivotally journaled in bearings not shown. The other leg of crank 103 extends radially from shaft 103 for pivotal connection at its remote end to connecting rod 97. Intermediate the plunger head 85 and crank 103, packing rod 101 passes through a guide collar 112 which is pivotally journaled on trunnion pins 113 between a pair of parallel, vertically oriented plates 114 attached to a pivotally mounted, generally horizontal indexing shaft 115 located generally above and parallel to packing shaft 104. The axes of the indexing shaft 115 and packing shaft 105 are also generally parallel to the axis of trunnion pins 113, connecting pins 106 and 110, pin 94 and output shaft 90 of the gear box 89.. It will therefore be appreciated that as output shaft 90 rotates causing the connecting rod 97 to reciprocate, the crank 103 will also reciprocate about packing shaft 104 causing packing rod 101 and plunger head 100 to reciprocate while the rod 101 is guided by the sliding connection in collar 112.

Figure 4:
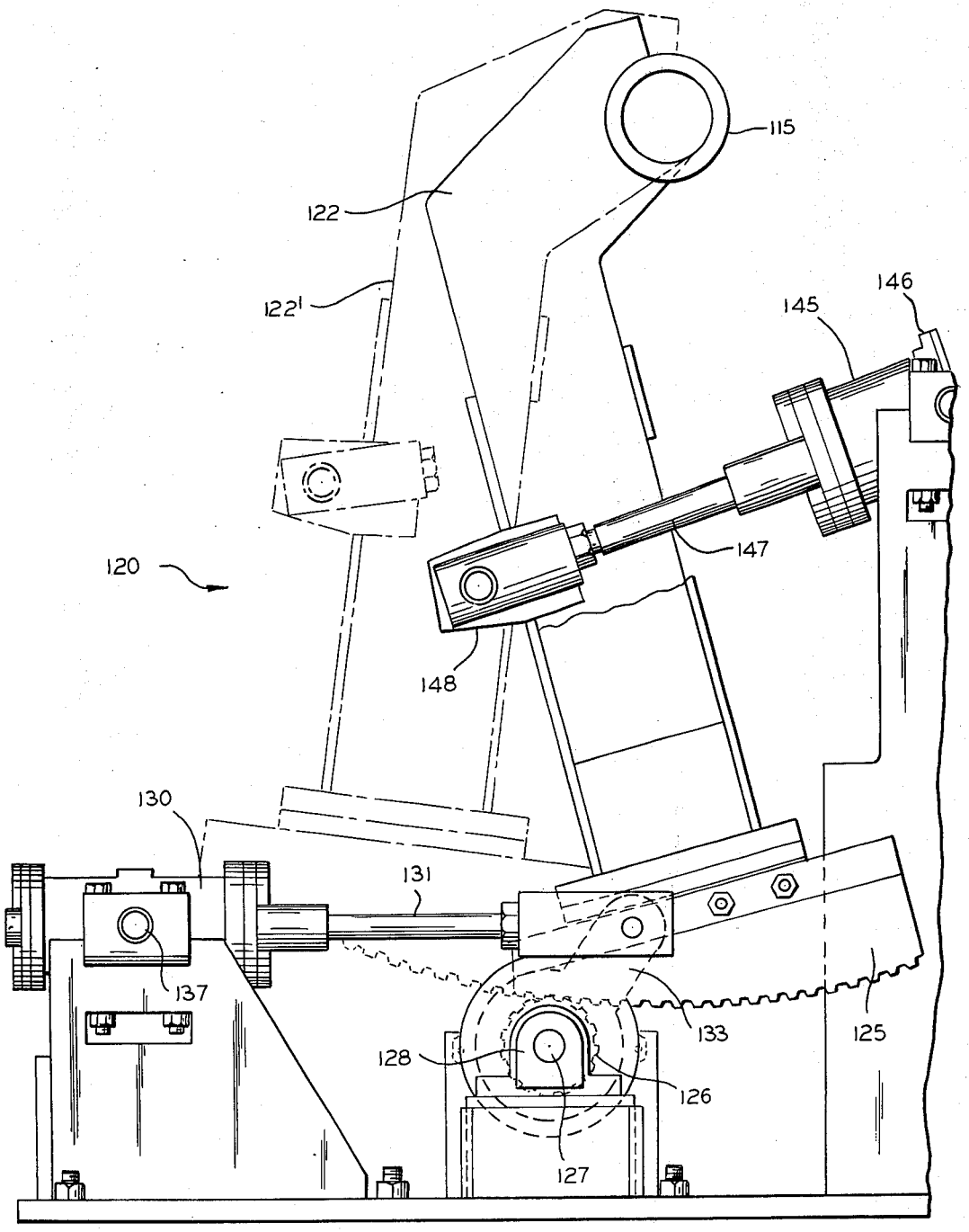
FIG. 4 is a fragmentary portion of the apparatus shown in FIG. 2 and illustrating the operation of the packing mechanism.

As shown in FIG. 2, the packing assembly is in its unextended position shown by full lines. Upon 180° rotation of output shaft 90, the plunger head 100 would advance to the position indicated by phantom lines thereby causing the strand 86 shown by broken lines to rotate 90° about its longitudinal axis in holding pocket 70 to the edgewise position indicated by full lines. In order to reorient the plunger assembly 83 for successive strands 86, the packing mechanism 80 is provided with an indexing assembly 120 which is shown in FIG. 4. The indexing assembly 120 includes a generally vertical indexing plate 122 which is affixed to indexing shaft 15. The indexing plate 122 may be pivoted through a number of positions as shown by full and broken lines in FIG. 4 in a manner to be described hereinafter so as to adjust the angular position of indexing shaft 115 thereby displacing the collar member 112 and changing the orientation angle of the reciprocating packing shaft 101. The indexing plate 122 may be caused to move between a number of successive positions by an arcuate gear rack 125 attached to the bottom of the indexing plate 122 and which meshes with a pinion gear 126 affixed to a horizontal pinion shaft 127 rotatably journaled in bearings 128. The pinion shaft 127 is rotated by means of an indexing cylinder 130 having an extensible shaft 131 which engages a radially extending plate 133 affixed to pinion shaft 127 through a clevis and pin assembly 135 affixed to the end of the cylinder shaft 131. The cylinder 130 itself may be journaled for pivotal motion by means of genrally horizontal trunnion pins 137 supported in spaced vertical supports 138. Control means, not shown, may be provided for successively extending cylinder shaft 131 in a stepwise fashion to a number of different positions thereby rotating the pinion shaft 127 and gear 126. This causes the rack 125 attached to the indexing plate 122 to travel along the pinion gear 126, thereby pivoting the indexing shaft 115. By changing the angular position of the indexing shaft 115, the position of collar 112 also varies so that the packing rod 101 and plunger head 100 are caused to travel along different angularly extending paths whereby the packing rod 101 may act upon successive strands to form a stack of metal strands 86 in the holding pocket 70. A second cylinder 145 is journaled by trunnion pins 146 and has its shaft 147 pivotally connected to indexing plate 122 by means of clevis and pin assembly 148. The cylinder 145 may be provided for returning the indexing plate 122 to its starting position so that a single acting indexing cylinder 130 may be utilized. While the control for the stacking assembly is not shown, it will be appreciated that it may take any form as an element which senses when a strand has come to rest in pocket 70 and which provides a signal to energize motor 82 for a single revolution of rod coupling 95 to move plunger assembly 83 through one cycle. A limit switch, not shown, may be coupled to pin 94 for actuating circuitry after each revolution of pin 94 for resetting motor 86 and stepping indexing cylinder 130 to its next position.

Cooling bed 27 is generally of the type having a plurality of stationary notched transfer bars 41 for supporting strands and a plurality of movable notched transfer bars 42 interspersed between the stationary bars 41. More specifically, as seen in FIGS. 2 and 3, the cooling bed 27 generally includes a plurality of spaced apart, parallel, horizontally extending notched or sawtooth transfer bars 41 which are fixed in position such as by mounting on a beam 155. A plurality of similarly configured, movable transfer bars 42 are interposed between and parallel to the fixed transfer bars 41. The bars 41 and 42 extend between the kick-off assembly 26 and shuffle bar assembly 29 for transporting metal strands from the run-in table 25 to the shuffle bar assembly 29. The ends of the fixed transfer bars 41 are attached to the lower holding pocket 70 while slots 156 are provided in the lower and upper holding pockets 70 and 73, respectively, in alignment with the movable transfer bars 42 so that the movable bars are free to move through and pick up metal strands from holding pockets 70 and 73 without interference.

Figure 5:
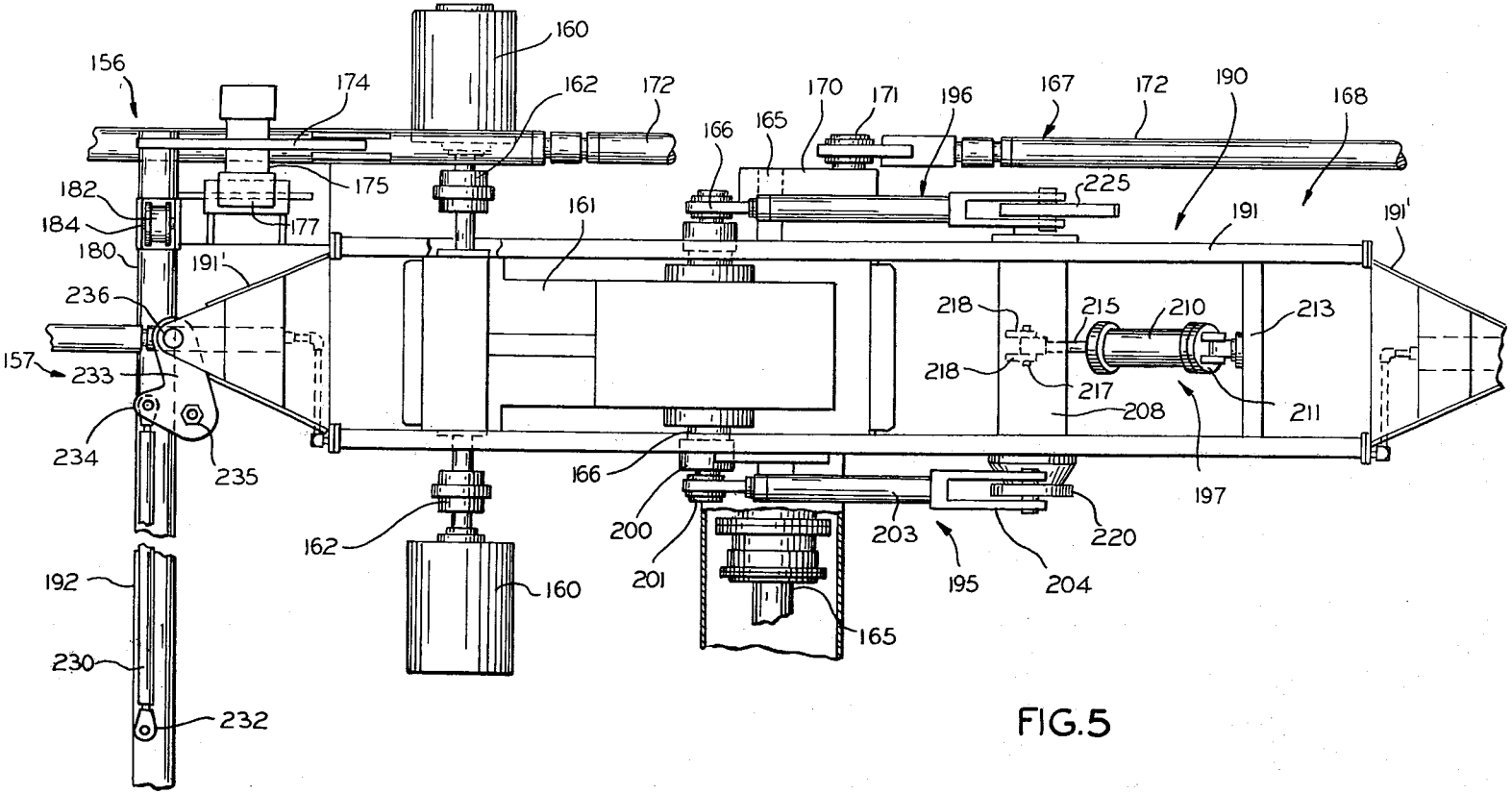
FIGS. 5 and 6 are fragmentary views illustrating the operation of the movable cooling bed carry-over bars.
Figure 6:
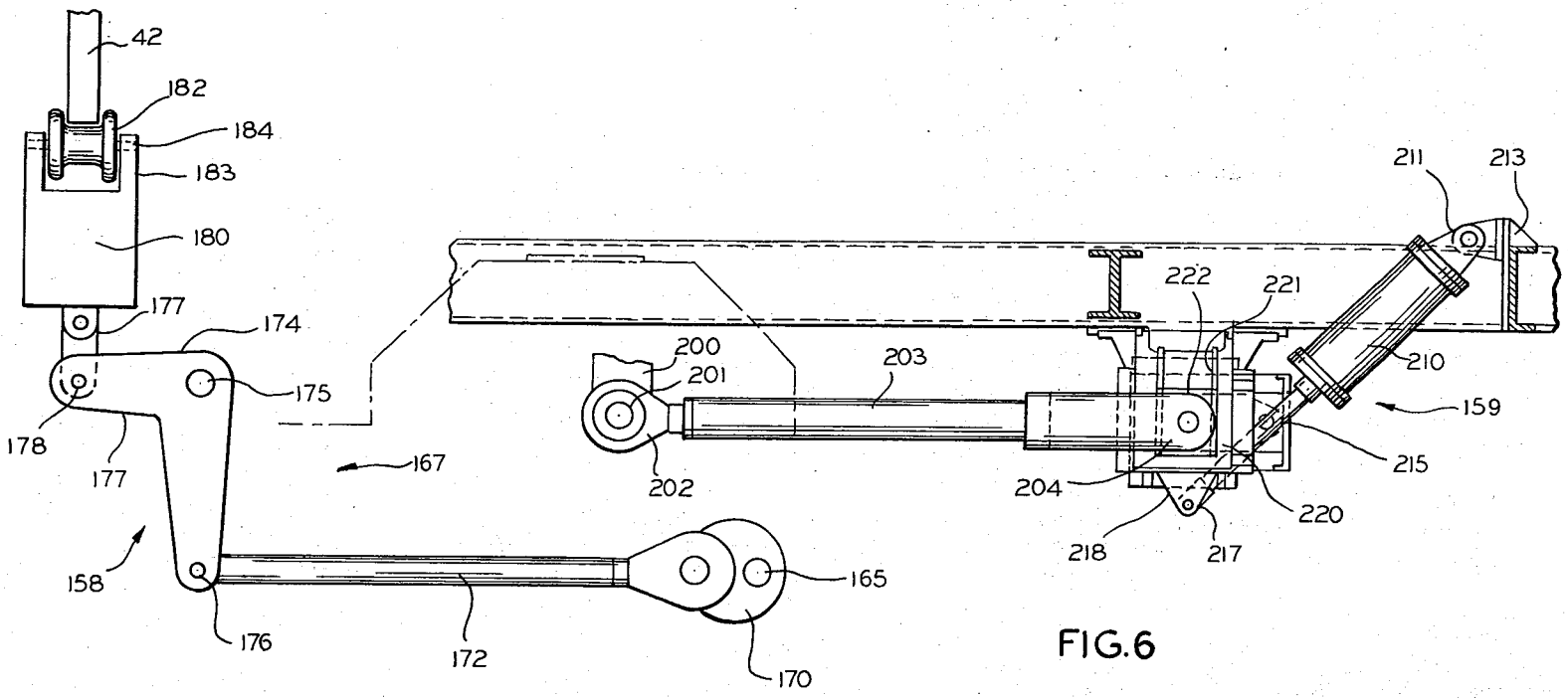

The mechanism for reciprocating the movable transfer bar is shown in FIGS. 5 and 6. Generaly, the mechanism for moving the movable carry-over bar 42 includes a first translating assembly 157 for moving the bar 42 horizontally, a second translating assembly 158 for moving bar 42 vertically and a switching assembly 159 (FIG. 6) for adjusting the horizontal component of said movement between a first distance and a second distance substantially twice said first distance.

Referring now to FIG. 5, the drive mechanism for the movable carry-over bar 42 may include a pair of drive motors 160 which are axially aligned on opposite sides of a gear box 161 and are coupled to input shafts thereof by conventional means such as couplings 162. The gear box 161 is suitably supported beneath the transfer bars 41 and 42 and has a first pair of axially aligned, horizontal output shafts 165 for driving a pair of lifting and lowering linkages 167 coupled to movable transfer bars 42 and which form a part of the first translating assembly 157, and a second pair of axially aligned horizontal output shafts 166 for driving a traversing linkage 168 which are also coupled to the movable rack bars 42 and form a part of the second translating means 158.

Since the lifting and lowering linkages 167 coupled to each side of the gear box 161 are identical, only one need be described in detail. As seen in FIGS. 5 and 6, the output shaft 165 has an eccentrically mounted crank member 170 affixed thereto. A crank shaft 171 extends from crank 170 with its axis generally parallel to that of shaft 165 and is rotatably connected to a generally horizontally extending lift rod 172 which extends generally perpendicularly to the bars 41 and 42 of the cooling table 27 and may pass beneath a plurality of said racks. At the point where lift rod 172 passes beneath movable bars 42, a crank 174 may be pivotally mounted on a horizontal pin 174 which extends generally perpendicular to the axis of lift rod 172. One leg of the crank 174 extends vertically downward from pin 175 and is pivotally connected to lift rod 172 by a pin 176 whose axis is generally parallel to that of pin 175. The other leg of crank 174 extends generally horizontally and terminates at a point beneath bar 42 where it is coupled by link 177 to the lower surface of a horizontal beam 180 extending generally parallel to the movable transfer bar 42. Beam 180 supports the movable transfer bar 42 on a horizontal roller 182 which is rotatably supported on beam 180 between generally vertically extending legs 183 and on a horizontal pin 184 having its axis perpendicular to the axis of bar 42. It may thus be seen that as crank member 170 is rotated on shaft 165, the lift rod 172 will be reciprocally driven back and forth beneath the cooling bed 27. Movement of the lift rod 172 will in turn pivot the crank 172 thereby lifting and lowering beam 180 which in turn lifts and lowers the movable transfer bar 42. This arrangement permits the lift rod 172 to simultaneously lift a number of beams similar to beam 180 beneath other movable rack members 42. The other lift linkage 167 disposed on the opposite side of gear box 161 will similarly impart a lifting force to the other end of beam 180 at a spaced apart location. It will be understood by those skilled in the art that any similar equivalent lifting mechanism could be employed to lift and lower the transfer bars 42.

With further reference to FIGS. 5 and 6, traversing linkage 168 includes a dual stroke traverse drive mechanism 190 for selectively varying the distance that the rack members 42 are moved back and forth along their longitudinal axes. The traversing drive mechanism 190 generally includes a box-like frame 191 which extends generally horizontally between beams 180 and is positioned between the transfer bars 41 and 42 and drive gear box 161. The opposite ends of the frame 191 terminate in a generally triangular end portion 191 which is slidingly supported on beams 180 and each of which is connected to a traverse drive linkage 192 coupled to a movable transfer 42.

Frame 190 may be reciprocatingly driven along its longitudinal axis by a short stroke drive linkage 195 located on one of its sides or a long stroke drive linkage 196 located on its opposite side. Switching bwtween a short stroke and a long stroke mode of operation is accomplished by a switch mechanism 197. As seen in FIG. 5, the short stroke drive linkage 195 includes a crank member 200 attached to the output shaft 166 of gear box 161. The crank member 200 has an eccentrically positoned shaft 201 which is pivotally journaled in a link 202 connected to one end of a generally horizontally extending drive rod 203. The opposite end of the drive rod 203 coupled by a clevis and pin assembly 204 to the switch mechanism 197 attached to frame 191.

The switch mechanism 197 includes a tubular member 208 which extends horizontally between the sides of frame 191 and is pivotally journaled therein. A switching cylinder 210 extends transversely relative to tubular member 208 and along the longitudinal axis of frame 191 and is pivotally supported at one end by a clevis and pin assembly 211 to a supporting crosspiece 213 between the sides of the frame 191. An extensible shaft 215 extends downwardly from cylinder 210 to a point beneath the tubular member 208 where the end of the shaft 215 is pivotally connected to a horizontal pin 217 extending between a pair of spaced parallel ears 218 attached to member 208. The axis of the connecting pin 217 is parallel to the axis of tubular member 208 so that upon extending or retracting the shaft 215 of cylinder 210, the tubular member 208 will be caused to pivot within the frame 191. A rectangular plate 220 is attached to an end of tubular member 208 which extends outside of frame 191 on the side adjacent the short stroke drive linkage 195. Plate 220 has a rectangular slot formed within its periphery and which has its longitudinal axis extending generally vertically when the assembly is in its short stroke position shown in FIG. 6. A sliding block 222 is fitted within slot 221 and is coupled by the clevis and pin assembly 204 to the short stroke linkage 195. It will thus be seen that as the crank 200 rotates, the drive rod 208 will reciprocate back and forth causing the block 222 to act against plate member 220 and thereby reciprocate the frame 191. As seen by broken lines in FIG. 7, when the cylinder shaft 215 is retracted to rotate tubular member 208 to its long stroke position, the attached plate member 220 will be rotated 90° to place the axis of longitudinal slot 221 in a direction generally parallel to that of the drive rod 203 so that upon reciprocation of rod 203 block 222 will merely reciprocate within the slot 221 without causing the framework 191 to reciprocate.

An identical drive arrangement is disposed on the opposite side of frame 191 except that linkage 196 is eccentrically mounted so as to have a greater degree of reciprocating travel. A plate member 225 is attached to the opposite end of tubular member 108 and has a slot similar to slot 220 except that the slot in plate member 225 is rotated 90° with respect to that in plate member 220. Therefore, when the cylinder shaft 215 is extended to provide for driving by the short drive rod 203, the longitudinal slot in plate 225 will be positioned to disengage the long stroke drive assembly 196 and the opposite will be true when the rod 203 is retracted for disengaging the short stroke drive assembly 195 and engaging the long stroke drive assembly 196.

FIG. 5 shows the traverse connecting linkage 192 which converts the reciprocating motion of frame 191 into the motion of the movable transfer bars 42. Linkage 192 comprises an elongated rod 230 which is pivotally connected to the bottom of rack member 42 by a pin 233. The opposite end of the rod 230 is pivotally connected to one leg of a crank 233 by means of a vertical pin 234 while the apex of crank 233 is connected to beam 180 by pin 235 and the other leg of crank 233 is pivotally connected to the frame 191 by a vertically extending pin 235. Reciprocation of frame 191 causes crank 233 to pivot about pin 235 and thereby causes the connecting rod 230 to reciprocate in a direction parallel to transfer bar 42. The connection of rod 230 to the rack member 42 through pin 232 causes longitudinal reciprocation of the rack 42 on rollers 182.

As seen in FIG. 2, with the short stroke mode of operation selected and by simultaneously operating the traversing linkage 168 and the lifting and lowering linkage 167, the rack members 42 may be reciprocated in an arc as depicted by line "A" whereby strands of metal will be lifted from holding pocket 70 and transported across cooling bed 27. Similarly, for dual stroke operation, the bar 42 will travel in a path similar to line "B", thereby causing strands picked up from the holding pockets 70 and 73 to be transported across two notches on bars 41 rather than one notch as in the single stroke mode of operation.

Figure 7:
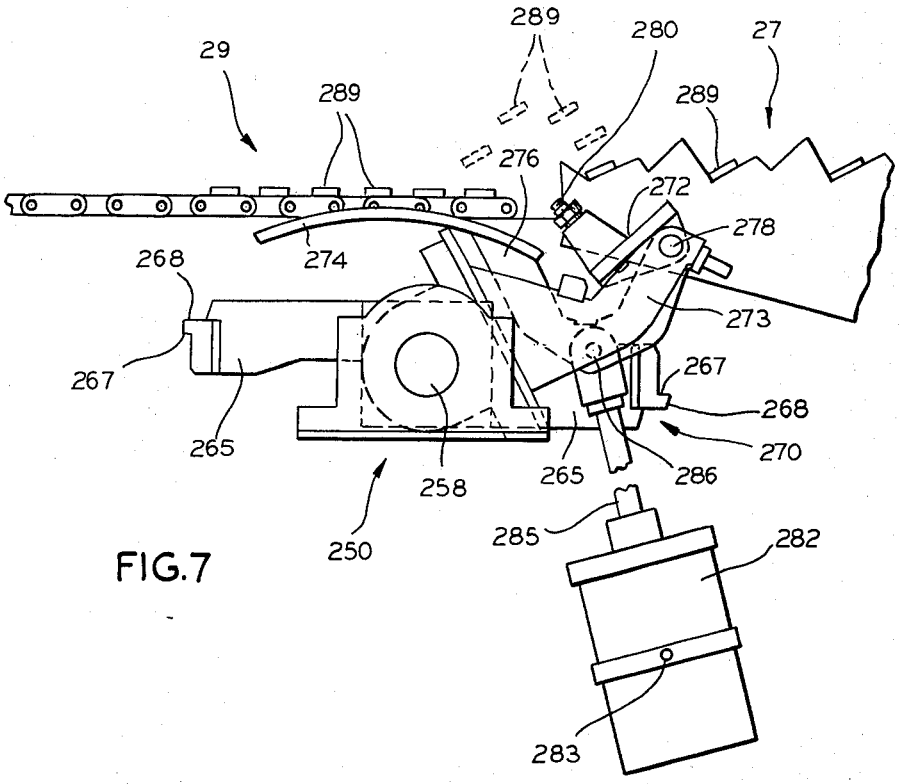
FIGS. 7 and 8 are fragmentary views illustrating the operation of the unscrambling mechanism.
Figure 8:
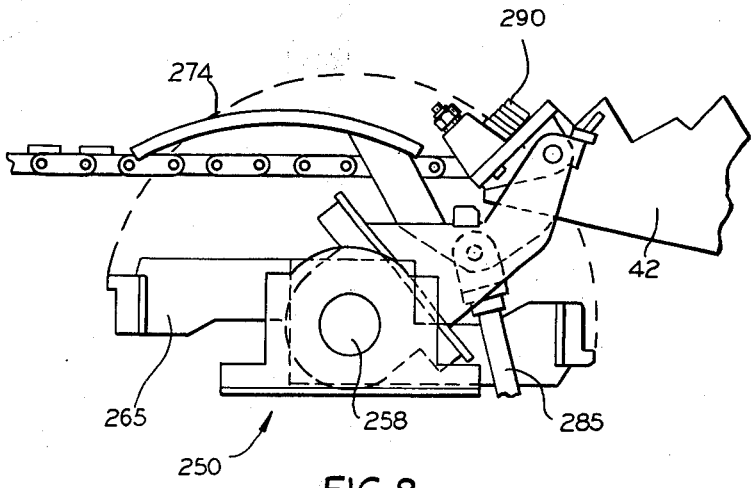

Reciprocation of the movable transfer bars 42 acts to transport metal strands across the cooling bed 27 to a conventional shuffle bar mechanism 29 which in turn moves the bars or strands to a run-out table 30 for transporting the bars for further processing. An unscrambling mechanism 250 as shown in FIGS. 7 and 8 may also be provided at the end of the cooling bed 27 for automatically separating metal strands which may be packed by the packing mechanism 80 and transported across the cooling bed 27. Generally, the mechanism 250 comprises a spaced pair of selectively operable, identical, unscrambling device, only one of which is shown in FIGS. 7 and 8, and which are coupled to a conventional drive unit (not shown) by means of a shaft 258 which extends generally perpendicularly to the motion of the strands across the cooling bed 25 and may be supportingly journaled in conventional bearings (not shown). It will be understood that shaft 258 may be coupled to other unscrambling mechanisms located along the cooling bed 27.

The unscrambling mechanism 251 is shown in FIG. 7 to include unscrambling arms 265 which are keyed to the shaft 258 and comprises a pair of opposed radially extending arms having notches 267 formed on their ends by a radially extending protrusion 268. Notches 267 are in the trailing edges of levers 265 relative to its direction of rotation. A selectively adjustable lift assembly 270 is disposed adjacent the unscrambling lever 265 and includes a notched pocket 272 which is connected by a pin 278 to the ends of a pair of spaced levers 273 pivotally journaled on shaft 258. An arcuate discharge guide bar 274 is mounted on levers 273 in spaced relation from the notched pocket 272 and extend in a direction generally parallel to strand travel across cooling bed 27 for guiding strands onto the shuffle bar assembly 29. An adjustable stop is provided by a threaded bolt 280 extending through notch member 272 and contacting the upper edge of plate member 276 at a point between pivot pin 278 and arcuate guide bar 274.

The notched pocket 272 and guide bar 274 may be pivoted to an operative position as seen in FIG. 8 by an actuating cylinder 282 which is mounted on generally horizontally extending trunnion pins 283 journaled in fixed supports (not shown) with the extensible cylinder shaft 285 extending upwardly and coupled to the lever 273 by means of a clevis and pin assembly 286 located intermediate the ends of levers 273 and unscrambler shaft 258. Suitable control means (not shown) are provided for selectively extending the cylinder shaft 285 to move lever 273 from its inoperative position shown in FIG. 7 to its operative position shown in FIG. 8. More specifically, when the notch 272 is retracted as shown in FIG. 8, it will not interfere with the transfer of strands 289 from the stationary carry-over bar 41 and onto the shuffle bars 29. However, extension of cylinder shaft 285 will pivot the notched pocket 272 through an arc and position to receive a pack of strands 290 from movable transfer bar 42. The unscrambler arms 265 may then be rotated by moving the notches 267 through the space occupied by the bottom strand of pack 290 on the notch pocket 272 whereby the strand will be stripped from the bottom of the pack and carried forward until it contacts the curved guide bar 274 at which pont the strand will be deflected by the curved guide bar 274 onto the shuffle bed assembly 29 for removal to the rollout table. The unscrambling arm 465 may be rotated for as many revolutions as necessary to remove all strands from pack 290.

Referring to FIGS. 9*a* – 9*g* which illustrate the delivery sequence of products from the run-in table 25 to the cooling bed 27, the lift aprons 38 and 39 are initially in an elevated position so that as the product (A for example in FIG. 2*a*) is received from the mill 15 on the run-in table rolls 35, the product slides down against the sides of the raised lift aprons. When a product has moved sufficiently down the table to where kick-off is to begin, the lift aprons 38 are lowered permitting the bar to side off the table rolls and on to the top of the lift apron. The lift aprons 38 are then raised to their mid position, allowing the product A to skid whereby its speed is reduced. After a strand speed reduction by about one-third, the lift aprons 38 are raised fully to transfer the product from the top of the lift apron into the holding notch 70 of the cooling bed. The breaking action to slow the bar by skidding starts as soon as the bar begins to transfer onto the lift apron from the table rolls and continues while the lift apron is being raised, while the bar is transferring from the lift apron to the stationary cooling bed skidding notch, and when in the notch itself until the bar reaches its final rest position.

Successful transfer requires that the lift aprons 38 and 39 be at least partially raised before the head end of the trailing product B can transfer onto the lift aprons. This is generally accomplished by operating the run-in rollers at a speed which is faster than the rate of product delivery from the rolling mill. In addition, a deflector plate (not shown) may be provided ahead of the first lift apron 30*a* or 39*a* and may be interlocked to the lift apron actuating mechanism so that when the lift aprons 33 or 39 are lowered, the deflector will be raised to direct the head end of the following bar B along the upper half of the table roller face for at least a partial distance.

To accommodate variations in mill speed and product range and different length bars, the lift aprons 38 and 39 are sectionalized 38*a* – 38*i* and 39*a* – 39*d* starting at the entry of the run-in table and continuing down the cooling bed area. As the required kick-off point moves down the bed, either due to shorter pieces or long pieces delivered at lower speeds, a portion or portions of the lift aprons 38 or 39 can be disengaged so that they remain in the raised position when the bar is transferred. These raised sections along with the separation distance prevent the head end of the trailing bar B from being transferred until the transfer of the leading bar A can be completed.

Figure 9I:
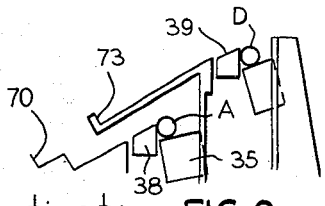
FIGS. 9*a* – 9*p* schematically illustrate the operation of the kick-off portion of the apparatus shown in FIG. 1.
Figure 9I:
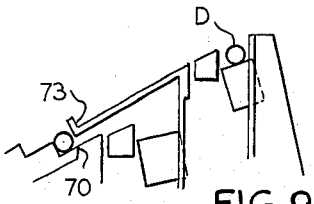
Figure 9J:
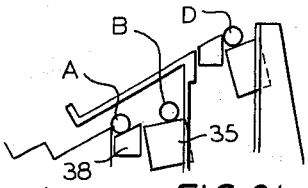
Figure 9J:
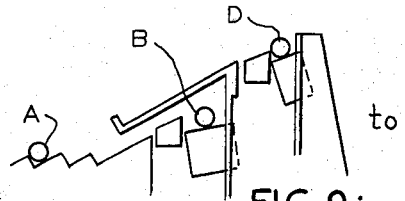
Figure 9C:
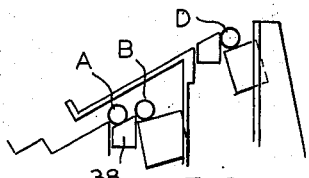
Figure 9K:
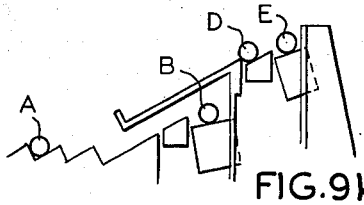
Figure 9M:
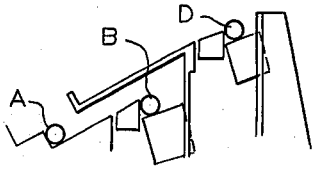
Figure 9M:
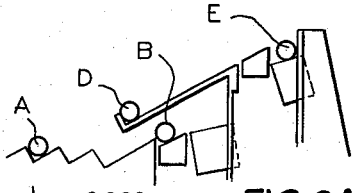
Figure 9M:
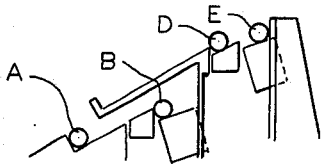
Figure 9M:
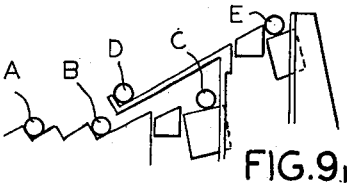
Figure 9P:
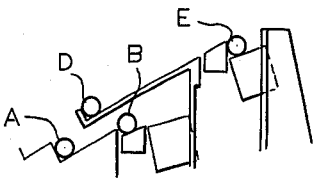
Figure 9P:
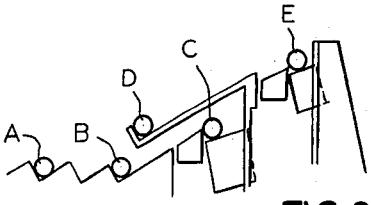
Figure 9P:
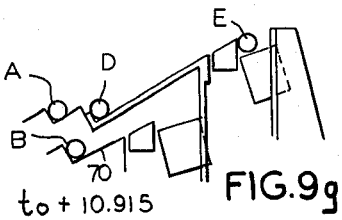
Figure 9P:
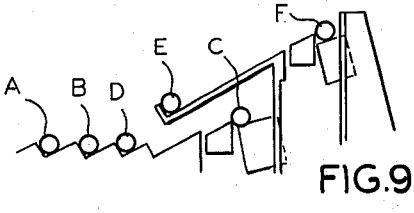
Figure 9H:
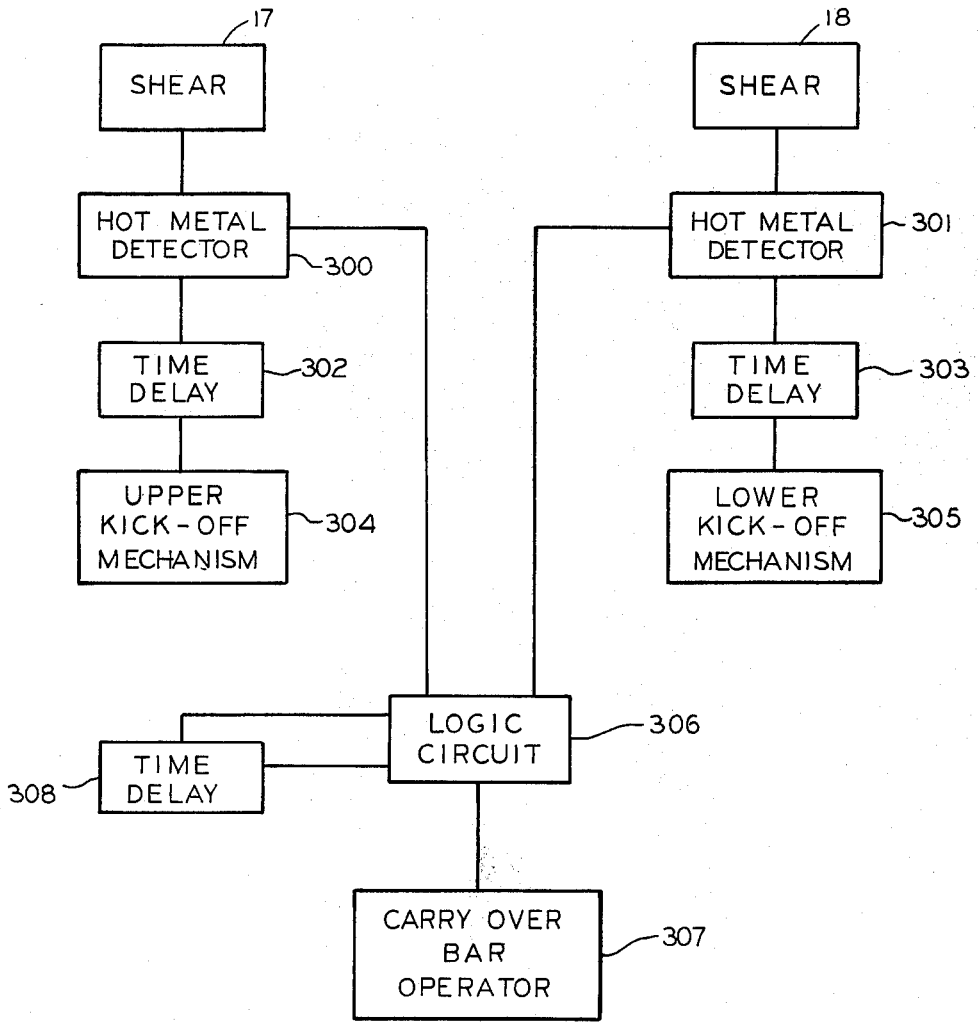

As shown schematically in FIG. 9*h*, hot metal detectors 300 and 301 are respectively located in the upper and lower portions of the run-in table 25 to detect the head end of the product. Time delay circuits 302 and 303 are coupled between the hot metal detectors and the upper and lower kick-off mechanism operators 304 and 305. Since the length of the product, the product speed and the distance from each hot metal detector 300 or 301 to the point at which the kick-off operation is to be initiated are all known, the time delay between the passage of the lead end of the product pass the hot metal detector and the initiation of a kick-off operation is to be commenced can be determined.

It will be appreciated that the speed at which the product can be delivered from the mill is determined by the cooling bed cycle time. For example, in one commecial application, the cooling bed cycle time is about 7.5 seconds with a cut bar length of about 300 feet, a cooling bed length of 330 feet, a skidding friction of 0.33 and a bar skidding distance of about 92 feet. The latter distance is that which the strand travels between the point that the kick-off operation begins and the strand comes to rest. Under such circumstances, the maximum mill speed of about 40 feet per second is possible. In order to separate the severed strand from that exiting the mill, the run-in rolls 20 and 21 will be rotated at a speed which will move the strand at a speed of about 10% greater than that of the mill, or as in the example, about 44 feet per second.

It will be appreciated that because the products delivered to the upper and lower holding notches 70 and 73 are spaced apart as a result of the faster speed imparted to the products by the rolls 38 and 39 over the mill delivery speed, it is possible to move the carry-over bars 42 through the holding notches for removing products therefrom without interference by a trailing product at the same level. This is complicated when it is desired to remove products simultaneously from both the upper and lower holding notches 70 and 73 because of the improbability that both products will skid to a halt simultaneously. Under such conditions the timing will be such that interference is avoided with trailing products in each of the upper and lower portions of the run-in table 25. Such timing is determined by the time required to move the carry-over bars 41 through each of the notches and the time lag between the upper and lower products. For example, in the above discussed commercial embodiment, a time of 0.75 seconds is required for the carry-over bar 42 to clear the lower notch 70 and 1.06 seconds to clear the upper notch 73 with a sequence clearance time of 0.55 seconds. In addition, the time between which the product is separated from the shear and it is deposited on the holding notch by the elevation of its respective lift apron is 3.415 seconds while the product skids to a hold in the holding notch 2.67 seconds later for a total transit time of 6.085 seconds. Under these conditions, it has been found that if the lower product leads the upper product by no more than 4.28 seconds both products can be removed simultaneously. However, if the lower product leads the upper product by more than 4.28 seconds, the lower product must be removed first, after which the upper product and the next succeeding lower product can be removed simultaneously.

This sequence of operation is illustrated in FIGS. 9*a* – 9*g* and 9*i* – 9*p*. For example, product A will leave the shear at time t0 and the lead end thereof will pass the hot metal detector (not shown) which will be located at some intermediate point in the run-out table 25. The hot metal detector will provide a signal to iniate the kick-off operation which preferably occurs after the trailing end of product A has moved approximately 80 feet down the run-in table. Accordingly, at time t0 + 1.935 seconds, the lift kick-off apron 38 will move down so that product A can begin moving off of the rolls 35 and onto the lift apron 38 whereupon product A will begin skidding (FIG. 9*b*). The lift apron 38 is then raised (FIG. 9*c*) to an intermediate position which is maintained while the product continues to skid so that the trailing bar B does not move onto the lift apron 38. At time t0 + 3.415 seconds, the lift apron 38 is raised discharging the product A into the holding notch 70 so that the product comes to rest at time t0 + 6.085 (FIG. 9*b*). The trailing product B will be delivered to the run-out table from the shear at time t0 + 7.5 seconds (FIG. 9*e*) and will progress in the manner of bar A so that the lift apron 38 will be raised to move product B onto the holding notch 70 at time t0 + 10.915. Prior to that time therefor, product A should have been removed by the operation of the cooling bed carry-over bar 42. In addition, if a product is also to be removed from the upper holding notch 73, it must be done at a sufficient interval prior to t0 + 10.915 so that the cooling bed carry-over bar 42 can move through the lower holding notch 70 without interference from product B. Since in the example, the cooling bed carry-over bar required 0.55 seconds clearance time and 1.06 seconds to clear both notches 70 and 73 and because product B is discharged onto the lower holding notch at time t0 + 10.915 seconds, the cooling bed carry-over bar must be actuated at least by t0 + 10.365 if is not to be interfered with by product B. Therefore, because product D must thus come to a rest by at least time t0 + 10.365 and because the bar stops at 6.085 seconds after operation of the shear, the product D in the upper table must follow product A by no more than 4.28 seconds if product A and product D are to be removed simultaneously by the cooling bed carry-over bar. Thus, when product A passes its hot metal detector 300, the position of product D will also be checked by hot metal detector 301 (FIG. 9*h*). If product D follows product A by no more than 4.28 seconds, the logic circuit 306 will operate the carry-over bar operator 307 when product D comes to rest and products A and D will be removed from their holding notches prior to the time that the lift apron is elevated to discharge product B onto the holding notch (FIG. 9*e*).

If upon checking the position of product D, it is determined that it trails product A by more than 4.28 seconds, the logic circuit 306 operates a time delay 308 prior to the operation of the cooling bed carry-over bar.

If the interval between products A and D exceeds 4.28 seconds, the logic circuit 306 will initiate the operation of the carry-over bar operator 307 and product A will be transferred from the holding notch by the carry-over bar 42 (FIG. 9*i*). In addition, a delay timer 308 will reset the logic circuit after a time delay initiates a new cooling bed carry-over cycle. This time delay is determined by the expression: $T = Vp^2/K = T_M - T_{CR}$ where T = the time delay, K = a constant, $Vp^2$ = product speed in the roller table, $T_M$ = safety margin time, and $T_{CR}$ = time required to move the carry-over drive from rest position to a point of contacting the product in the notches 70 and 73. The product delivered to the upper holding notch 73 then becomes the leading strand and that delivered to the lower holding notch 70 becomes the trailing strand. The cooling bed carry-over cycle will operate in this mode so long as the upper strand leads the lower strand by no more than 3.22 seconds for the illustrated example. Here the cutting of strand D will define time t0 (FIG. 9*i*) so that strand D will skid to a stop at time t0 + 6.095 (FIG. 9*e*) and strand B will skid to a stop 3.22 seconds thereafter, or at time t0 + 9.305 (FIG. 9*n*). The lift apron will move strand E, which follows strand D, into the holding notch 73 at time t0 + 10.915 (FIG. 9*p*). As indicated above, the operating bed carry-over bar requires 1.06 seconds to move through the upper and lower holding notches and must have, in addition, at least 0.55 seconds of clearance time. So long as the upper product continued to lead the lower product by no more than 3.22 seconds, the cooling bed carry-over would continue to cycle in this manner. Accordingly, the cycle would be initiated when the upper product was sensed by the hot metal detector 301, at which time the position of the lower product would be sensed and if the time interval was less than 3.22 seconds, the cooling bar would continue to cycle in this fashion. If the trailing lower product lagged by more than 3.22 seconds, the logic circuit 306 would initiate the operaton of carry-over bar operator 307 and after the time delay, would initiate the sequence wherein the lower product would be leading inasmuch as when the gap between the upper bar and the lower bar exceeds 3.22 seconds, the gap between the lower product and the next succeeding upper product would be less than 4.28 seconds.

If a single strand is being handled, only the lower run-in table need be used. In such a case, the dual stroke traversing linkage 16B may be set for either short or long stroke mode of operation depending on the product whereby the movable carry-over bars 42 will be cycled through one or two notch spaces of longitudinal motion. If required during single strand operation, products may be inverted to the upper run-in table in case the lower table may be inoperative. In this case, the dual stroke traversing linkage 168 will be set for the long stroke mode of operation only. When strands are being transferred from both the upper and lower kick-off assemblies 26 and 27, the dual stroke traversing linkage 168 will be switched to a long stroke mode of operation so that movable racks 42 are cycled to transfer strands from both the lower and upper holding racks 70 and 73 onto the fixed cooling bed rack members 41 and the strands will be transferred across the cooling bed two at a time by virtue of the simultaneous transfer from the holding pockets to the cooling bed 27.

For conventional strand products, the packing and unpacking mechanisms 80 and 250 will not be employed and the strands will be transferred across the cooling bed 27 to shuffle bars 29 and thence to run-out table 30. Certain mill products, such as flats, however, are often formed into packs to retard the cooling of the strands as they travel across the cooling bed 27. If packing is desired, only the lower run-in rolls 35 are used and the product is transferred in the manner just described to the lower holding pocket 70. As the flats are transferred to the holding pocket, the movable racks 42 will not be cycled immediately. Instead, the packing mechanism 80 will be operated as previously described to form the flats edgewise as seen in FIG. 2 and successive flats will be similarly turned by indexing the packing assembly 83 to various positions to handle successive flats and form them into a pack of a predetermined number of flats. After a pack is formed the dual stroke traversing linkage will be set for the long stroke mode of operation whereby the movable cooling bed racks 42 will be cycled through two notch spaces and the packs will occupy each alternate pocket. The same procedure will be followed for successive flats entering the run-in table. As the packs are transferred across the cooling bed to the final cooling bed, notch 291 of fixed rack members 41 as seen in FIG. 8, the pack unscrambling mechanism 250 will be actuated to place the pack onto the movable notch member 272 and the pack unscrambled in the manner, which has been previously described to transfer the flats singly onto shuffle bars of the shuffle bar assembly 29 for transfer to run-out table 30.

While only a single embodiment of the invenion has been shown and described, it is not intended to be limited thereby but only by the scope of the appended claims.

I claim:

1. A method of simultaneously transferring pairs of elongate metal strands from pairs of inlets of a cooling bed, which metal strands precede further successive pairs of elongate metal strands, received from a rolling mill, the steps of sensing when said first metal strand has reached a predetermined position in one inlet, sensing when the next succeeding metal strand is received at a predetermined position of a second inlet, removing said first metal strand from said one inlet when the time lapse between said first and second metal strands is larger than a predermined time interval, and delaying the removal of said first metal strand from said one inlet if said time lapse is below a predetermined time and simultaneously removing said two metal strands from both of said inlets.

2. The method set forth in claim 1, and including the steps of successively transferring metal strands from run-in means to receiving means at each inlet, said predetermined time being less than the time between such succesive transfers to each receiving means.

3. The method set forth in claim 2 and including the steps of successively sensing when successive strands reach a predetermined point at each inlet and successively removing strands from one inlet when the time lapse between which said metal strands are received at predetermined positions of their respective inlet means are above a predetermined amount and removing strands simultaneously from said inlets when said time is less than said amount.

4. The method set forth in claim 3 and including the steps of moving said products in step-by-step manner through substantially equal increments between said inlets and discharge means, adjusting the length of said steps for a first incremental distance when products are received only at the first one of said inlets and moving said members through a second distance substantially twice said incremental step when products are received at each of said pair of inlets.

5. The method set forth in claim 4 wherein each of said pair of inlets includes run-in means each adapted to receive said products from a rolling mill and kick-off means adapted to receive said products from said run-in means and for selectively moving said products to associated holding means and including the step of removing the products from said holding means before the delivery thereto of a succeeding product from said run-in means.

6. The method of simultaneously transferring elongate products from a roling mill and for displacing said products in one direction across a cooling bed from an inlet to discharge means, alternately delivering individual ones of said products to first and second holding means, sensing the delivery rate of products to each holding means, removing the product received by one holding means after the transfer of said products thereto and, delaying the removal of said products from said one holding means if a product is received by the other holding means before the delivery of a second product to said one holding means, and simultaneously removing products from both holding means.

* * * * *